United States Patent [19]

Haluska et al.

[11] Patent Number: 5,008,320

[45] Date of Patent: Apr. 16, 1991

[54] PLATINUM OR RHODIUM CATALYZED MULTILAYER CERAMIC COATINGS FROM HYDROGEN SILSESQUIOXANE RESIN AND METAL OXIDES

[75] Inventors: Loren A. Haluska; Keith W. Michael, both of Midland; Leo Tarhay, Sanford, all of Mich.

[73] Assignee: Dow Corning Corporation, Midland, Mich.

[21] Appl. No.: 447,482

[22] Filed: Dec. 7, 1989

Related U.S. Application Data

[62] Division of Ser. No. 938,678, Dec. 4, 1986, Pat. No. 4,911,992.

[51] Int. Cl.[5] ..... C08K 3/10; C08K 5/07

[52] U.S. Cl. ..... 524/361; 428/457; 428/688; 428/698; 428/704; 501/103; 501/127; 501/128; 501/134; 501/153; 501/154; 524/413; 524/437; 524/490; 524/588; 528/15; 528/31

[58] Field of Search ..... 501/103, 127, 128, 134, 501/153, 154; 428/698, 457, 688, 704; 524/490, 588, 859, 437, 413, 361; 528/15, 31

[56] References Cited

U.S. PATENT DOCUMENTS

| | | | |
|---|---|---|---|
| 4,822,697 | 4/1989 | Haluska et al. | 427/38 |
| 4,847,162 | 7/1989 | Haluska et al. | 427/38 |
| 4,849,296 | 7/1989 | Haluska et al. | 427/58 |
| 4,898,907 | 2/1990 | Haluska et al. | 106/287.1 |

*Primary Examiner*—Mark L. Bell

*Attorney, Agent, or Firm*—Roger E. Gobrogge

[57] ABSTRACT

This invention relates to materials produced by diluting in a solvent a platinum or rhodium catalyzed preceramic mixture of a hydrogen silsesquioxane resin and a metal oxide precursor selected from the group consisting of an aluminum alkoxide, a titanium alkoxide, and a zirconium alkoxide. The preceramic mixture solvent solution is applied to a substrate and ceramified by heating. One or more ceramic coatings containing silicon carbon, silicon nitrogen, or silicon carbon nitrogen can be applied over the ceramified $SiO_2$/metal oxide coating. A CVD or PECVD top coating can be applied for further protection. The invention is particularly useful for coating electronic devices.

5 Claims, No Drawings

PLATINUM OR RHODIUM CATALYZED MULTILAYER CERAMIC COATINGS FROM HYDROGEN SILSESQUIOXANE RESIN AND METAL OXIDES

This is a continuation of co-pending U.S. application Ser. No. 06/938,678 filed on Dec. 4, 1986, now U.S. Pat. No. 4,911,992.

BACKGROUND OF THE INVENTION

Electronic devices, to be serviceable under a wide variety of environmental conditions, must be able to withstand moisture, heat, and abrasion resistance, among other stresses. A significant amount of work has been reported directed toward the preparation of coatings for electronic devices which can increase the reliability of the devices. None of the conventional coatings available today, including ceramic and metal packaging, can perform well enough by itself to protect an electronic device against all environmental stresses.

A common cause of failure of electronic devices is microcracks or voids in the surface passivation of the semiconductor chip allowing the introduction of impurities. Thus a need exists for a method which will overcome the formation of microcracks, voids or pinholes in inorganic coatings of electronic devices.

Passivating coatings on electronic devices can provide barriers against ionic impurities, such as chloride ion ($Cl-$) and sodium ion ($Na+$), which can enter an electronic device and disrupt the transmission of electronic signals. The passivating coating can also be applied to electronic devices to provide some protection against moisture and volatile organic chemicals.

Amorphous silicon (hereinafter a-Si) films have been the subject of intense research for various applications in electronic industries however, the use of a-Si films for environmental or hermetic protection of electronic devices is unknown. A number of possible processes have been previously disclosed for forming a-Si films. For instance, for producing films of amorphous silicon, the following deposition processes have been used, chemical vapor deposition (CVD), plasma enhanced CVD, reactive sputtering, ion plating and photo-CVD, etc. Generally, the plasma enhanced CVD process is industrialized and widely used for depositing a-Si films.

Known to those skilled in the art is the utility of substrate planarization as an interlayer within the body of an electronic device and between the metallization layers. Gupta and Chin (Microelectronics Processing, Chapter 22, "Characteristics of Spin-On Glass Films as a Planarizing Dielectric", pp 349–65, American Chemical Society, 1986) have shown multilevel interconnect systems with isolation of metallization levels by conventional interlevel dielectric insulator layers of doped or undoped $SiO_2$ glass films. However, CVD dielectric films provide only at best a conformal coverage of substrate features which is not conducive to continuous and uniform step coverage by an overlying metallization layer. The poor step coverage results in discontinuous and thin spots in the conductor lines causing degradation of metallization yields as well as device reliability problems. Spin-on glass films have been utilized to provide interlayer isolation between the metallization layers, the top layer of which is later patterned by lithographic techniques. Topcoat planarization on the surface of an electronic device as opposed to planarizing interlevel dielectric layers, however, is unknown.

Under the teachings of the prior art, a single material most often will not suffice to meet the ever increasing demands of specialty coating applications, such as those found in the electronics industry. Several coating properties such as microhardness, moisture resistance, ion barrier, adhesion, ductility, tensile strength, thermal expansion coefficients, etc., need to be provided by successive layers of different coatings.

Silicon and nitrogen-containing preceramic polymers, such as silazanes have been disclosed in various patents, including Gaul U.S. Pat. No. 4,404,153 issued Sep. 13, 1983, wherein there is disclosed a process for preparing R',SiNH- containing silazane polymers by contacting an reacting chlorine-containing disilanes with $(R',Si)_2NH$ where R' is vinyl, hydrogen, an alkyl radical of 1 to 3 carbon atoms or the phenyl group. Gaul also teaches therein the use of the preceramic silazane polymers to produce silicon-carbon-nitrogen-containing ceramic materials.

Gaul in U.S. Pat. No. 4,312,970, issued Jan. 26, 1982, obtained ceramic materials by the pyrolysis of preceramic silazane polymers, which polymers were prepared by reacting organochlorosilanes and disilazanes.

Gaul in U.S. Pat. No. 4,340,619, issued July 20, 1982, obtained ceramic materials by the pyrolysis of preceramic silazane polymers, which polymers were prepared by reacting chlorine-containing disilanes and disilazanes.

Cannady in U.S. Pat. No. 4,540,803, issued Sep. 10, 1985, obtained ceramic materials by the pyrolysis of preceramic silazane polymers, which polymers were prepared by reacting trichlorosilane and disilazanes.

Frye and Collins teach in U.S. Pat. No. 3,615,272, issued Oct. 26, 1971, and also in Frye, et al., J. Am. Chem. Soc., 92, p. 5586, 1970, the formation of hydrogen silsesquioxane resin.

Dietz et al. U.S. Pat. No. 3,859,126, issued Jan. 7, 1975, teaches the formation of a composition comprising PbO, $B_2O_3$, and ZnO, with optional various oxides including $SiO_2$.

Rust et al., U.S. Pat. No. 3,061,587, issued Oct. 30, 1963, teaches a process for forming ordered organo silicon-aluminum oxide copolymers by reacting dialkyl diacyloxysilane or dialkyl dialkoxysilane, with trialkylsiloxy dialkoxy aluminum.

The instant invention relates to the enhancement of the protection of electronic devices by the low temperature formation of thin multilayer ceramic or ceramic-like coatings on the surface of the device. What has been discovered is a method of forming coatings from hydrogen silsesquioxane resin and one or more metal oxides, which are subsequently coated with one or more silicon, or silicon and nitrogen, or silicon and carbon and nitrogen-containing, ceramic or ceramic-like coatings.

SUMMARY OF THE INVENTION

The instant invention relates to the low temperature formation of monolayer and multilayer protective coatings for the protection of electronic devices. The monolayer coatings of the present invention consist of coating prepared by contacting platinum or rhodium catalyzed hydrogen silsesquioxane resin, $(HSiO_{3/2})_n$, with zirconium, aluminum. and/or titanium alkoxides to produce a homogeneous preceramic polymer material. The dual-layer coatings of the present invention consist of (1) a coating prepared by contacting platinum or rhodium catalyzed hydrogen silsesquioxane resin, (HSi- $O_{3/2})_n$, with zirconium, aluminum, and/or titanium alkoxides and (2) a topcoat of silicon-containing material, or silicon nitrogen-containing material, or silicon carbon-containing material, derived by heating a silane, halosilane. halodisilane, halopolysilane or mixture thereof to provide protection. The first layer is a $SiO_2/TiO_2$, or $SiO_2/ZrO_2$, or $SiO_2/TiO_2/ZrO_2$, or $SiO_2/Al_2O_3$, or $SiO_2/TiO_2/ZrO_2/Al_2O_3$ planarizing and passivating coating that is applied by known techniques, including flow coating, spin coating, dip coating and spray coating of an electronic device and then ceramifying. The second layer of the dual-layer coatings of the instant invention is a protective barrier coating of silicon-containing material derived from the CVD or plasma enhanced CVD of silanes alkylsilanes, halosilanes, halodisilanes, silazanes, or mixtures of alkanes, silanes, and ammonia.

The instant invention also relates to the low temperature formation of a three layer coating system for electronic devices wherein the first layer is a platinum or rhodium catalyzed $SiO_2/TiO_2$, or $SiO_2/ZrO_2$, or $SiO_2/TiO_2/ZrO_2$, or $SiO_2/Al_2O_3$, or $SiO_2/TiO_2/ZrO_2/Al_2O_3$ coating. The second layer, used for passivation, is a ceramic or ceramic-like coating obtained by the ceramification of a preceramic silicon nitrogen-containing polymer coating, or is a silicon nitrogen-containing, silicon carbon nitrogen-containing, or silicon carbon-containing layer deposited by thermal UV, CVD, plasma enhanced CVD or laser techniques. The third layer in the three layer coatings of the present invention is a top coating of (a) silicon-containing material applied by CVD, plasma enhanced CVD, or metal assisted CVD of a halosilane, halodisilane halopolysilane, or mixtures thereof, or (b) silicon carbon-containing material, applied by CVD or plasma enhanced CVD of a halosilane, halodisilane, halopolysilane, or mixtures thereof and an alkane, or (c) silicon nitrogen-containing material applied by CVD or plasma enhanced CVD of a silane, halosilane, halodisilane, halopolysilane, or mixtures thereof, and ammonia or (d) silicon carbon nitrogen-containing material applied by CVD or plasma enhanced CVD of hexamethyldisilazane or CVD or plasma enhanced CVD of mixtures of a silane an alkylsilane, an alkane and ammonia.

DETAILED DESCRIPTION OF THE INVENTION

The instant invention relates to the discovery that platinum or rhodium catalyzed hydrogen silsesquioxane resin, $(HSiO_{3/2})_n$, can be contacted with zirconium, aluminum or titanium alkoxides to prepare novel preceramic polymers that can be converted at low temperatures to ceramic or ceramic-like materials useful as planarizing coatings for irregular surfaces of electronic devices. In the instant invention, by "alkoxide" is meant any alkoxy, acyloxy, dialkoxy, trialkoxy, or tetraalkoxy organic group which is bonded to a metal and which can be hydrolyzed and subsequently pyrolyzed under the ceramification conditions stated herein to produce a metal oxide. By the instant invention ceramic or ceramic-like planarizing coating compositions such as $SiO_2/ZrO_2$, $SiO_2/TiO_2$, $SiO_2/TiO_2/ZrO_2$, and $SiO_2/Al_2O_3$ have been prepared. These metal oxide ceramic or ceramic-like coatings minimize mechanical stresses due to the irregular topography of an integrated circuit or electronic device and also help prevent microcracking of subsequent multilayer coatings under thermal cycling conditions.

The use of platinum catalysts, such as, for example, $(CH_3CH_2S)_2PtCl_2$, and $Pt(CH_3CH(O)CHCH(O)CH_3)_2$, or rhodium catalyst, such as $RhCl_3(CH_2CH_2CH_2CH_2S)_3$, in the instant invention enhances the oxidation and cure of the $(HSiO_{3/2})_n$ resin. In addition, the platinum and/or rhodium catalysis of the instant invention assists in the reduction or elimination of residual SiH functionality on the $(HSiO_{3/2})_n$ resin, further increasing the production of $SiO_2$. Furthermore, catalysis of the hydrogen silsesquioxane resin planarizing layer with platinum and/or rhodium complexes significantly reduces the weight loss observed on curing.

In the instant invention, by "ceramic-like" is meant those pyrolyzed silicon-nitrogen containing materials which are not fully free of residual carbon and/or hydrogen but which are otherwise ceramic-like in character. By "electronic device" in the instant invention is meant devices including, but not limited to, electronic devices, silicon based devices, gallium arsenide devices, focal plane arrays, opto-electronic devices, photovoltaic cells and optical devices.

The preceramic hydrogen silsesquioxane resin material can be prepared by the method of Frye, et al. U.S. Pat. No. 3,615,272, issued Oct. 26, 1971.

The invention further relates to the discovery that these ceramics can be used as coatings for multilayer electronic devices as well as other integrated circuits. The coatings of the instant invention are also useful for functional purposes not related to protection of the substrate, such as, dielectric layers, doped dielectric layers to produce transistor-like devices, pigment loaded binder systems containing silicon to produce capacitors and capacitor-like devices multilayer devices. 3-D devices, silicon-on-insulator (SOI) devices, super lattice devices and the like.

It is an object of the instant invention to provide a process to produce ceramic or ceramic-like planarizing coatings from carbon-free precursor materials. This is achieved according to the process of the present invention by the use of platinum and/or rhodium catalyzed hydrogen 25 silsesquioxane resin $(HSiO_{3/2})_n$ solution deposited onto an electronic device and ceramified.

The instant invention further relates to the discovery that these catalyzed silicon dioxide ($SiO_2$-containing) ceramic or ceramic-like coatings can be coated with various silicon, carbon and/or nitrogen-containing materials for the protection of electronic devices as well as other integrated circuits.

The instant invention also relates to the formation of silicon- and nitrogen-containing passivating coatings and silicon-containing top coatings for ceramic or ceramic-like coated electronic devices whereby the top coating is prepared by CVD, plasma enhanced CVD or metal catalyzed CVD techniques.

The monolayer coatings of the present invention are produced by coating a substrate with a planarizing coating by means of diluting with a solvent a preceramic mixture of hYdrogen silsesquioxane resin and a metal oxide precursor selected from the group consisting of an aluminum alkoxide, a titanium alkoxide, and a zirconium alkoxide, catalyzing the diluted preceramic mixture solution with a metal catalyst selected from the group consisting of platinum catalysts and rhodium catalysts, and coating a substrate with the diluted catalyzed preceramic mixture solution drying the diluted catalyzed preceramic mixture solution so as to evaporate the solvent and thereby deposit a catalyzed preceramic coating on the substrate, ceramifying the preceramic coating to silicon dioxide and metal oxide by heating the coated substrate to produce a monolayer ceramic or ceramic-like coating on the substrate.

The coatings produced by the instant invention exhibit strong adhesion to many substrates including, but not limited to, electronic devices, and are abrasion and moisture resistant. The choice of substrates and devices to be coated by the instant invention is limited only by the need for thermal and chemical stability of the substrate at the lower decomposition temperature in the atmosphere of the decomposition vessel.

In addition, the instant invention relates to a method of forming a multilayer, ceramic or ceramic-like, coating which method comprises (A) coating an electronic device with a planarizing coating by means of diluting with a solvent a preceramic mixture of hydrogen silsesquioxane resin and a metal oxide precursor selected from the group consisting of an aluminum alkoxide, titanium alkoxide, and zirconium alkoxide, catalyzing the diluted preceramic mixture solution with a metal catalyst selected from the group consisting of platinum catalysts and rhodium catalysts, coating an electronic device with said diluted catalyzed preceramic mixture solution, drying the diluted catalyzed preceramic mixture solution so as to evaporate the solvent and thereby deposit a homogeneous catalyzed preceramic coating on the electronic device, ceramifying the preceramic coating to silicon dioxide and metal oxide by heating the coated device to produce a ceramic or ceramic-like coating, and (B) applying to the ceramic or ceramic-like coating on the electronic device a silicon-containing coating by means of decomposing in a reaction chamber a silane, halosilane, halodisilane or mixture thereof in the vapor phase, at a temperature between 200 and 1000 degrees Centigrade, in the presence of the ceramic coated device, whereby an electronic device containing a multilayer, ceramic, coating thereon is obtained. The method for coating the electronic device with the preceramic solvent solution can be, but is not limited to, flow coating, spin coating, spray or dip coating techniques.

The instant invention further relates to a method of forming a multilayer ceramic or ceramic-like, protective coating comprising (A) coating an electronic device with a coating by means of diluting to low solids in a solvent a hydrogen silsesquioxane preceramic mixture, which has been contacted with tetra n-propoxy zirconium catalyzing the diluted preceramic mixture solution with a metal catalyst selected from the group consisting of platinum catalysts and rhodium catalysts, coating an electronic device with said diluted catalyzed preceramic mixture solution, drying the diluted catalyzed preceramic mixture solution so as to evaporate the solvent and thereby deposit a catalyzed preceramic coating on the electronic device, ceramifying the Preceramic coating to silicon dioxide and zirconium dioxide by heating the coated device to produce a ceramic or ceramic-like coating, and (B) applying to the ceramic or ceramic-like coating on the electronic device a silicon-containing coating by means of decomposing in a reaction chamber a silane, halosilane, halodisilane or mixture of halosilanes in the vapor phase, at a temperature between 200 and 400 degrees Centigrade, in the presence of the coated device, whereby an electronic device containing a multilayer, ceramic or ceramic-like, protective coating thereon is obtained.

The instant invention further relates to a method of forming a multilayer, ceramic or ceramic-like coating which method comprises (A) coating an electronic device with a coating by means of diluting to low solids in a solvent a hydrogen silsesquioxane preceramic polymer resin mixture, which has been contacted with tetra isobutoxy titanium, catalyzing the diluted preceramic mixture solution with a metal catalyst selected from the group consisting of platinum catalysts and rhodium catalysts, coating an electronic device with said diluted catalyzed preceramic mixture solution, drying the diluted catalyzed preceramic mixture solution so as to evaporate the solvent and thereby deposit a preceramic catalyzed coating on the electronic device, ceramifying the preceramic coating to silicon dioxide and titanium dioxide by heating the coated device to produce a ceramic or ceramic-like coating, and (B) applying to the coated device a silicon-containing coating by means of decomposing in a reaction chamber a silane, halosilane, halodisilane or mixture of halosilanes in the vapor phase, at a temperature between 200 and 400 degrees Centigrade, in the presence of the coated device, whereby an electronic device containing a multilayer, ceramic or ceramic-like coating thereon is obtained.

The instant invention further relates to a method of forming a multilayer, ceramic or ceramic-like coating which method comprises (A) coating an electronic device with a coating by means of diluting to low solids in a solvent a hydrogen silsesquioxane preceramic polymer resin mixture, which has been contacted with an aluminum alkoxide, catalyzing the diluted preceramic mixture solution with a metal catalyst selected from the group consisting of platinum catalysts and rhodium catalysts, coating an electronic device with said diluted catalyzed preceramic mixture solution, drying the diluted catalyzed preceramic mixture solution so as to evaporate the solvent and thereby deposit a preceramic coating on the electronic device, ceramifying the preceramic coating to silicon dioxide and aluminum oxide by heating the coated device to produce a ceramic or ceramic-like coating, and (B) applying to the ceramic or ceramic-like coating on the electronic device a silicon-containing coating by means of decomposing in a reaction chamber a silane, halosilane, halodisilane or mixture of halosilanes in the vapor phase, at a temperature between 200 and 400 degrees Centigrade, in the presence of the coated device, whereby an electronic device containing a multilayer, ceramic or ceramic-like protective coating thereon is obtained.

The instant invention further relates to a method of forming a multilayer, ceramic or ceramic-like coating which method comprises (A) coating an electronic device with a coating by means of diluting with a solvent a preceramic mixture of hydrogen silsesquioxane resin and a metal oxide precursor selected from the group consisting of an aluminum alkoxide, titanium alkoxide, and zirconium alkoxide, catalyzing the diluted preceramic mixture solution with a metal catalyst selected from the group consisting of platinum catalysts and rhodium catalysts, coating an electronic device with said diluted catalyzed preceramic mixture solution, drying the diluted catalyzed preceramic mixture solution so as to evaporate the solvent and thereby deposit a catalyzed preceramic coating on the electronic device, ceramifying the catalyzed preceramic coating to silicon dioxide and metal oxide by heating the coated device to produce a ceramic or ceramic-like coating, and (B) applying to the coated device a passivating coating which comprises a silicon nitrogen-containing material by means of diluting to low solids in a solvent a preceramic silicon nitrogen-containing polymer, coating the ceramic coated device with the diluted preceramic silicon nitrogen-containing polymer solution, drying the diluted preceramic silicon nitrogen-containing polymer solution so as to evaporate the solvent and thereby deposit a preceramic silicon nitrogen-containing coating on the coated electronic device, heating the coated device in an inert or ammonia-containing atmosphere to produce a ceramic or ceramic-like silicon nitrogen-containing coating, and (C) applying to the coated device a silicon-containing coating by means of decomposing in a reaction chamber a silane, halosilane, halodisilane, halopolysilane or mixture thereof in the vapor phase, at a temperature between 200 and 900 degrees Centigrade, in the presence of the coated device, whereby an electronic device containing a multilayer, ceramic or ceramic-like coating thereon is obtained.

The ceramification of the planarizing and passivating coatings utilized in the multilayer coatings of the instant invention can be achieved at temperatures between 200 and 1000 degrees Centigrade and preferably at temperatures between 200 and 400 degrees Centigrade.

In the instant invention, a preceramic polymer containing hydrogen silsesquioxane resin, $(HSiO_{3/2})_n$, which can be prepared by the method of Frye, et al. U.S. Pat. No. 3,615,272, is diluted after the incorporation of, for example, tetra n-propoxy zirconium, $Zr(OCH_2CH_2CH_3)_4$, or tetra isobutoxy titanium, $Ti(OCH_2CH(CH_3)_2)_4$, to low solids (e.g., 0.1 to 10 weight %) in a solvent such as toluene, methyl ethyl ketone, or n-heptane. To the solution is added the platinum or rhodium catalyst in the form of, for example, 60 parts per million of $(CH_3CH_2S)_2PtCl_2$ in 0.01 gram of toluene. The diluted catalyzed preceramic polymer solvent solution is then coated onto an electronic device and the solvent allowed to evaporate by drying. The method of coating the diluted preceramic polymer solution onto the electronic device can be, but is not limited to, spin coating, dip coating, spray coating, or flow coating. By this means is deposited a homogeneous catalyzed preceramic coating which is ceramified by heating the coated device for approximately twenty hours at 200 degrees Centigrade or for one hour at 400 degrees Centigrade. This represents a significant processing temperature reduction over that of the prior art. Thin ceramic or ceramic-like planarizing coatings of less than 2 microns (or approximately 5000 A) are thus produced on the devices. The planarizing coatings thus produced can then be coated with a passivating silicon nitrogen-containing coating of the present invention or with a CVD or PECVD applied silicon-containing coating, silicon carbon-containing coating, silicon nitrogen-containing coating, silicon carbon nitrogen-containing coating, or a combination of these coatings.

Another significant result of catalyzing the silsesquioxane resin with platinum and/or rhodium is the beneficial reduction in the amount of weight loss observed on exposure to elevated temperatures. Thus, the silsesquioxane resin exposed to increasing temperatures in thermogravimetric analysis (TGA) under a helium atmosphere but in absence of platinum catalyst, exhibited a 20% weight loss while the silsesquioxane resin catalyzed with the platinum catalyst exhibited only a 14% weight loss. The significant improvement of 6% in reduction of weight loss resulting from the platinum catalyst is indicative of improved crosslinking of the resin to form higher molecular weight polymers with higher char yields, a feature important in ceramification.

Furthermore, TGA experiments run in air on the uncatalyzed and platinum catalyzed silsesquioxane resin demonstrate a 9% weight loss in the former but a 6% weight gain in the latter, i.e., the catalyzed sample displayed an initial 4% loss as unreacted material volatilized but upon continued heating from about 400 degrees to 1000 degrees Centigrade the sample gained 6% weight above the starting weight as a result of oxidation.

With rhodium catalysis, another sample of hydrogen silsesquioxane resin heated to 1000° Centigrade under helium exhibited a 30% weight loss but a 68% weight loss was observed under identical conditions without the rhodium catalysis. When catalyzed with rhodium and oxidized in air, the hydrogen silsesquioxane resin exhibited a 7% weight gain, similar to the gain observed with platinum catalysis, due to oxygen incorporation. However, in the absence of rhodium catalyst, the same resin lot showed a 28% weight loss upon heating to 1000° Centigrade in air.

Thus, the platinum catalyst or rhodium catalyst facilitates the oxidation of any residual SiH moieties first to SiOH and then further to SiOSi. This oxidative weight gain phenomenon was not observed in the uncatalyzed silsesquioxane resin samples. The higher molecular weights and reduction in weight loss achievable by the present invention are important advances over the prior art because subsequent ceramification of the higher molecular weight polymers can produce higher ceramic yields.

The cure of the hydrogen silsesquioxane resin is not limited herein to oxidative curing in air. The above discussion illustrates the utility of the present invention to cure the hydrogen silsesquioxane resin with platinum catalysts or rhodium catalysts in the absence of air. In addition, the resin can be cured with platinum or rhodium catalysts in an ammonia-containing atmosphere.

The platinum catalysts and rhodium catalysts operative in the present invention include, but are not limited to, $(CH_2CH_2S)_2PtCl_2$, platinum acetylacetonate, and rhodium catalyst $RhCl_3(CH_2CH_2CH_2CH_2S)_3$, obtained from Dow Corning Corporation, Midland, Michigan. Any platinum or rhodium compound or complex which can be solubilized in the hydrogen silsesquioxane resin will serve to catalyze the cure and is within the scope of this patent.

Sample formulations of the planarizing coatings of the instant invention include, but are not limited to, those depicted in Table I.

TABLE I

Composition of Some Planarizing Coatings of the Instant Invention

| Sample No. | $SiO_2$ wt. % | $ZrO_2$ wt. % | $TiO_2$ wt. % | $Al_2O_3$ wt. % |
|---|---|---|---|---|
| 1 | 90 | 10 | | |
| 2 | 100 | | | |
| 3 | 90 | | 10 | |
| 4 | 74.7 | | | 25.3 |
| 5 | 80 | 10 | 10 | |
| 6 | 70 | 10 | 10 | 10 |
| 7 | 80 | | 20 | |
| 8 | 70 | | 30 | |
| 9 | 80 | 20 | | |
| 10 | 70 | 30 | | |

TABLE I-continued

| Composition of Some Planarizing Coatings of the Instant Invention | | | | |
|---|---|---|---|---|
| Sample No. | $SiO_2$ wt. % | $ZrO_2$ wt. % | $TiO_2$ wt. % | $Al_2O_3$ wt. % |
| 11 | 70 | | | 30 |

where wt % is weight per cent; $ZrO_2$ is zirconium dioxide produced from zirconium alkoxide; $TiO_2$ is titanium dioxide produced from titanium alkoxide; $Al_2O_3$ is aluminum oxide produced from aluminum pentanedionate.

While Table I indicates a metal alkoxide composition in the coatings of 10 % weight per cent, the concentration range of metal oxide may vary from 0.1 % weight per cent metal alkoxide up to approximately 30 % weight percent. By varying the ratio of hydrogen silsesquioxane resin to metal alkoxide (and thus to the resulting metal oxide) specific formulations with desired coefficients of thermal expansion (CTE) can be designed. It is desirable in coating electronic devices that the CTE of the coating allow for sufficient thermal expansion so as to minimize the formation of microcracks upon exposure of the coated device to temperature variations. Table II shows the CTE values for several common ceramic materials used in coating electronic devices and also the CTE values of ceramic planarizing coatings of the instant invention.

TABLE II

| Coefficients of Thermal Expansion | |
|---|---|
| Metal Oxide | CTE |
| Titanium dioxide, $TiO_2$ | 9.4 |
| Aluminum oxide, $Al_2O_3$ | 7.2–8.6 |
| Zirconium dioxide, $ZrO_2$ | 7.6–10.5 |
| Silica, $SiO_2$ | 0.5 |
| Silicon, Si | 2.14 |
| 80% $SiO_2$/20% $TiO_2$ | 2.28 |
| 75% $SiO_2$/25% $TiO_2$ | 2.63 |
| 90% $SiO_2$/10% $TiO_2$ | 1.39 |
| 90% $SiO_2$/10% $ZrO_2$ | 1.21 |
| 70% $SiO_2$/30% $TiO_2$ | 3.17 |
| 70% $SiO_2$/30% $ZrO_2$ | 2.63 |
| 80% $SiO_2$/20% $ZrO_2$ | 1.92 |
| 75% $SiO_2$/25% $Al_2O_3$ | 2.18 |
| 75% $SiO_2$/25% $ZrO_2$ | 2.28 |

The source for the reference data appearing above is "Ceramic Source". American Chemical Society, vol. 1., 1985, p. 350–1. The CTE values for the compositions of the instant invention are calculated.

The chemical compounds in which the aluminum, zirconium and titanium are operative in the present invention are not limited to the oxide or dioxide forms listed above but include any and all forms and mixtures of the metals which can be blended with the hydrogen silsesquioxane resin and ceramified to produce the mixed oxide planarizing coating system of the instant invention.

The second and passivating silicon nitrogen-containing layer of the composite coatings in the instant invention provides resistance against ionic impurities. Preceramic silicon nitrogen-containing polymers suitable for use in this present invention are well known in the art, including, but not limited to, silazanes, disilazanes, polysilazanes, cyclic silazanes and other silicon nitrogen-containing materials. The preceramic silicon nitrogen-containing polymers suitable for use in this invention must be capable of being converted to a ceramic or ceramic-like material at elevated temperatures. Mixtures of preceramic silazane polymers and/or other silicon- and nitrogen-containing materials may also be used in this invention. Examples of preceramic silazane polymers or polysilazanes suitable for use in this invention include polysilazanes as described by Gaul in U.S. Pat. No(s). 4,312,970 (issued Jan. 26, 1982), 4,340,619 (issued July 20, 1982), 4,395,460 (issued July 26, 1983), and 4,404,153 (issued Sep. 13, 1983), all of which are hereby incorporated by reference. Suitable polysilazanes also include those described by Haluska in U.S. Pat. No. 4,482,689 (issued Nov. 13. 1984) and by Seyferth et al. in U.S. Pat. No. 4,397,828 (issued Aug. 9, 1983), and Seyferth et al, in U.S. Pat. No. 4,482,669 (issued Nov. 13, 1984) which are hereby incorporated by reference. Other polysilazanes suitable for use in this invention are disclosed by Cannady in U.S. Pat. No(s). 4,540,803 (issued Sep. 10, 1985), 4,535,007 (issued Aug. 13, 1985), and 4,543,344 (issued Sep. 24, 1985), and by Baney et al. in U.S. patent application Ser. No. 652,939, filed Sep. 21, 1984, all of which are hereby incorporated by reference. Also suitable for use in this invention are dihydridosilazane polymers prepared by the reaction of $H_2SiX_2$, where X= a halogen atom, and $NH_3$. These $(H_2SiNH)_n$ polymers are well known in the art, but have not been used for the protection of electronic devices. (See, for example, Seyferth. U.S. Pat. No. 4,397,828. issued Aug. 9, 1983).

Also to be included as preceramic silicon nitrogen-containing polymer materials useful within the scope of the present invention are the novel preceramic polymers derived from cyclic silazanes and halogenated disilanes, and also the novel preceramic polymers derived from cyclic silazanes and halosilanes. These materials are disclosed and claimed in patent applications of Ser. No(s). 926,145, titled "Novel Preceramic Polymers Derived From Cyclic Silazanes And Halogenated Disilanes And A Method For Their Preparation", and 926,607, titled "Novel Preceramic Polymers Derived From Cyclic Silazanes And Halosilanes And A Method For Their Preparation", respectively, filed in the name of Loren A. Haluska and hereby incorporated by reference. The above-described novel preceramic silicon nitrogen-containing polymers derived from cyclic silazanes and halosilanes and/or halogenated disilanes are also useful for the protection of any substrate able to withstand the temperatures necessary for ceramification of the preceramic polymers. Still other silicon- and nitrogen-containing materials may be suitable for use in the present invention.

A preferred temperature range for ceramifying or partially ceramifying the silicon nitrogen-containing preceramic polymer is from 200 to 400 degrees Centigrade. A more preferred temperature range for ceramifying the silicon nitrogen-containing preceramic polymer is from 300 to 400 degrees Centigrade. However, the method of applying the heat for the ceramification or partial ceramification of the silicon nitrogen-containing coating is not limited to conventional thermal methods. The silicon nitrogen-containing polymer coatings useful as planarizing and passivating coatings in the instant invention can also be cured by other radiation means such as, for example, exposure to a laser beam. However, the present invention is not limited to ceramification temperatures below 400° Centigrade. Ceramification techniques utilizing temperatures up to and including at least 1000° Centigrade will be obvious to those skilled in the art, and are useful in the present invention where the substrate can withstand such temperatures.

By "cure" in the present invention is meant coreaction and ceramification or partial ceramification of the starting material by heating to such an extent that a solid polymeric ceramic or ceramic-like coating material is produced.

Alternatively, in the three layer coating of the instant invention, the second and passivating coating can be selected from the group consisting of silicon nitrogen-containing material, silicon carbon nitrogen-containing material and silicon carbon-containing material. The silicon nitrogen-containing material is deposited by the CVD or plasma enhanced CVD of the reaction product formed by reacting silane, halosilanes, halopolysilanes, or halodisilanes and ammonia. The silicon carbon-containing material is deposited by the CVD or plasma enhanced CVD of the reaction product formed by reacting silane, halosilanes, halopolysilanes, or halodisilanes and an alkane of one to six carbon atoms or alkylsilane. The silicon carbon nitrogen-containing material is deposited by the CVD or PECVD of hexamethyldisilazane or the CVD or PECVD of mixtures of a silane, an alkylsilane, an alkane of one to six carbon atoms, and ammonia.

The second and passivating coating of the multilayer coatings of the instant invention can be produced by applying to the planarizing coating a passivating ceramic or ceramic-like coating selected from the group consisting of (i) a silicon nitrogen-containing coating, (ii) a silicon carbon-containing coating, and (iii) a silicon carbon nitrogen-containing coating wherein the silicon nitrogen-containing coating is applied onto the ceramic or ceramic-like coated electronic device by a means selected from the group consisting of (a) chemical vapor deposition of a silane, halosilane, halodisilane, halopolysilane or mixtures thereof in the presence of ammonia, (b) plasma enhanced chemical vapor deposition of a silane, halosilane, halodisilane halopolysilane or mixtures thereof in the presence of ammonia, (c) ceramification of a silicon and nitrogen-containing preceramic polymer; and wherein the silicon carbon nitrogen-containing coating is applied onto the ceramic or ceramic-like coated electronic device by a means selected from the group consisting of (1) chemical vapor deposition of hexamethyldisilazane, (2) plasma enhanced chemical vapor deposition of hexamethyldisilazane, (3) chemical vapor deposition of a silane, alkylsilane, halosilane, halodisilane, halopolysilane or mixture thereof in the presence of an alkane of one to six carbon atoms or an alkylsilane and further in the presence of ammonia, and (4) plasma enhanced chemical vapor deposition of a silane, alkylsilane, halosilane, halodisilane, halopolysilane or mixture thereof in the presence of an alkane of one to six carbon atoms or an alkylsilane and further in the presence of ammonia; and wherein the silicon carbon-containing coating is deposited by a means selected from the group consisting of (i) chemical vapor deposition of a silane, alkylsilane, halosilane, halodisilane, halopolysilane or mixtures thereof in the presence of an alkane of one to six carbon atoms or an alkylsilane and (ii) plasma enhanced chemical vapor deposition of a silane, alkylsilane, halosilane, halodisilane, halopolysilane or mixtures thereof in the presence of an alkane of one to six carbon atoms or an alkylsilane, to produce the passivating ceramic or ceramic-like coating.

The preceramic silazane or other silicon nitrogen-containing polymer solvent solution is coated (by any method discussed above) onto the electronic device previously coated with the ceramified $HSiO_{3/2}$/metal alkoxide coating, such as $HSiO_{3/2}/Zr(OCH_2CH_2CH_2)_4$ resin, or $HSiO_{3/2}/Zr(OCH_2CH_2CH_3)_4$/ $Ti(OCH_2CH_2CH_2CH_3)_4$ resin and the solvent allowed to evaporate by drying. By this means is deposited a preceramic polymer coating which is ceramified by heating the coated device for approximately one hour at temperatures up to 400 degrees Centigrade under argon. Thin ceramic passivating coatings of less than 2 microns (or approximately 5000 Angstroms) are thus produced on the devices.

The third layer of the multilayer coatings of the instant invention can be produced by applying to the passivating ceramic or ceramic-like coating a silicon-containing coating selected from the group consisting of (i) a silicon coating, (ii) a silicon carbon-containing coating, (iii) a silicon nitrogen-containing coating, and (iv) a silicon carbon nitrogen-containing coating, wherein the silicon coating is applied onto the passivating coating by a means selected from the group consisting of (a) chemical vapor deposition of a silane, halosilane, halodisilane, halopolysilane or mixtures thereof (b) plasma enhanced chemical vapor deposition of a silane, halosilane, halodisilane, halopolysilane or mixtures thereof, or (c) metal assisted chemical vapor deposition of a silane, halosilane, halodisilane, halopolysilane or mixtures thereof, and wherein the silicon carbon-containing coating is applied by a means selected from the group consisting of (1) chemical vapor deposition of a silane, halosilane, halodisilane, halopolysilane or mixtures thereof in the presence of an alkane of one to six carbon atoms or an alkylsilane, (2) plasma enhanced chemical vapor deposition of a silane, alkylsilane, halosilane, halodisilane, halopolysilane or mixtures thereof in the presence of an alkane of one to six carbon atoms or an alkylsilane; and wherein the silicon nitrogen-containing coating is deposited by a means selected from the group consisting of (A) chemical vapor deposition of a silane, halosilane, halodisilane, halopolysilane or mixtures thereof in the presence of ammonia, (B) plasma enhanced chemical vapor deposition of a silane, halosilane, halodisilane, halopolysilane or mixtures thereof in the presence of ammonia, and (C) ceramification of a silicon and nitrogen-containing preceramic polymer, and wherein the silicon carbon nitrogen-containing coating is deposited by a means selected from the group consisting of (i) chemical vapor deposition of hexamethyldisilazane, (ii) plasma enhanced chemical vapor deposition of hexamethyldisilazane, (iii) chemical vapor deposition of a silane, alkylsilane, halosilane, halodisilane, halopolysilane or mixture thereof in the presence of an alkane of one to six carbon atoms or an alkylsilane and further in the presence of ammonia, and (iv) plasma enhanced chemical vapor deposition of a silane, alkylsilane, halosilane, halodisilane, halopolysilane or mixture thereof in the presence of an alkane of one to six carbon atoms or an alkylsilane and further in the presence of ammonia; to produce the silicon-containing coating on the electronic device. The silicon-containing protective third layer or topcoat of the composite coatings of the present invention can be obtained at relatively low reaction temperature by the metal-assisted CVD process claimed in the parallel Sudarsanan Varaprath U.S. patent application Ser. No. 835,029, filed Feb. 2, 1986 and entitled "Silicon-containing Coatings and a Method for Their Preparation", or by conventional non-metal assisted CVD and plasma enhanced CVD techniques. The high temperature conditions of the conventional CVD technique normally limit the type of substrate materials which can be coated. Thus, electronic devices which cannot be heated over 400 degrees Centigrade without damage cannot be coated by conventional CVD techniques. The choice of substrates and devices to be coated by the instant invention is limited only by the need for thermal and chemical stability of the substrate at the lower decomposition temperature in the atmosphere of the decomposition vessel.

Coatings produced by the instant invention possess low defect density and are useful on electronic devices as protective coatings, as corrosion resistant and abrasion resistant coatings, as temperature and moisture resistant coatings, as dielectric layers and as a diffusion barrier against ionic impurities such as $Na^+$and $Cl^-$. The $SiO_2$/metal oxide coatings and the silicon nitrogen-containing ceramic or ceramic-like coatings of the instant invention are also useful as interlevel dielectrics within the body of the electronic device and between the metallization layers, thereby replacing spin-on glass films.

The coatings of the present invention are useful for functional purposes in addition to protection of electronic devices from the environment. The coatings of the present invention are also useful as dielectric layers, doped dielectric layers to produce transistor-like devices, pigment loaded binder systems containing silicon to produce capacitors and capacitor-like devices, multilayer devices. 3D devices, silicon-on-insulator (SOI) devices, and super lattice devices.

EXAMPLE 1.

A preceramic polymer containing hydrogen silsesquioxane resin, $(HSiO_{3/2})_n$, produced by the method of Frye et al., supra, was diluted in n-heptane and mixed at a 9:1 molar ratio with tetra n-propoxy zirconium, $Zr(OCH_2CH_2CH_3)_4$, to a final solids concentration of 1.0 weight per cent. The solvent solution was catalyzed by adding 0.01 grams of toluene in which was dissolved 60 parts per million of $(CH_3CH_2S)_2PtCl_2$. This catalyzed preceramic polymer solvent solution was allowed to remain at room temperature for 24 hours. The diluted catalyzed preceramic polymer solvent solution was then flow coated onto a CMOS electronic device and the solvent allowed to evaporate by drying. By this means was deposited a preceramic polymer coating which was ceramified by heating the coated device in a two inch Lindberg furnace for approximately twenty hours at 200 degrees Centigrade. Additional coatings were also ceramified at 400 degrees Centigrade for one hour. Thin ceramic planarizing coatings of less than 2 microns (or approximately 4000 A) were thus produced on the devices.

EXAMPLE 2.

A preceramic polymer mixture containing 90% hydrogen silsesquioxane resin, $(HSiO_{3/2})_n$, and 10% tetra isobutoxy titanium, $Ti(OCH_2CH(CH_3)_2)_4$, was prepared in n-heptane at a concentration of 1 weight per cent. The preceramic solution was catalyzed by adding 0.01 grams of 0.5% solution in n-heptane of rhodium catalyst $RhCl_3(CH_3CH_2CH_2CH_2S)_3$, obtained from Dow Corning Corporation as DC2-7039. The catalyzed diluted preceramic polymer solution was allowed to stand at room temperature for 24 hours. The dilute catalyzed Preceramic polymer solvent solution was then flow coated onto an electronic device and the solvent allowed to evaporate by drying. By this means was deposited a catalyzed preceramic polymer coating which was ceramified by heating the coated device for approximately twenty hours at 200 degrees Centigrade or for one hour at 400 degrees Centigrade. Thin ceramic planarizing coatings of less than 2 microns (or approximately 4000 A) were thus produced on the devices.

EXAMPLE 3.

A preceramic polymer mixture containing 80% hydrogen silsesquioxane resin, $(HSiO_{3/2})_n$, 10% tetra isobutoxy titanium, $Ti(OCH_2C(CH_3)_2)_4$, and 10% tetra n-propoxy zirconium, $Zr(OCH_2CH_2CH_2)_4$, was prepared at low solids, 1.0 weight per cent, in methyl ethyl ketone. The preceramic polymer solvent solution was catalyzed by the method of Example 1, above, and allowed to stand at room temperature for 24 hours. The dilute catalyzed preceramic polymer solvent solution was then flow coated onto an electronic device and the solvent allowed to evaporate by drying. By this means was deposited a catalyzed preceramic polymer coating which was ceramified by heating the coated device for approximately twenty hours at 200 degrees Centigrade or for one hour at 400 degrees Centigrade. Thin ceramic planarizing coatings of less than 2 microns (or approximately 4000 Angstroms) were thus produced on the devices.

EXAMPLE 4.

A preceramic polymer mixture containing 70% hydrogen silsesquioxane resin, $(HSiO_{3/2})_n$, 10% tetra isobutoxy titanium, $Ti(OCH_2C(CH_3)_2)_4$, 10 tetra n-propoxy zirconium, $Zr(OCH_2CH_2CH_3)_4$, and 10% aluminum pentanedionate, $Al(CH_3COCH_2COCH_3)_3$ was prepared at low solids. 1.0 weight percent, in methyl ethyl ketone. The preceramic polymer solvent solution was catalyzed by the method of Example 2, above, and allowed to stand at room temperature for 24 hours. The dilute catalyzed preceramic polymer solvent solution was then flow coated onto an electronic device and the solvent allowed to evaporate by drying. By this means was deposited a catalyzed preceramic polymer coating which was ceramified by heating the coated device for approximately twenty hours at 200 degrees Centigrade or for one hour at 400 degrees Centigrade. Thin ceramic planarizing coatings of less than 2 microns (or approximately 4000 Angstroms) were thus produced on the devices.

EXAMPLE 5.

A preceramic silazane polymer, prepared by the method of Cannady in Example 1 U.S. Pat. No. 4,540,803, was diluted to 1.0 weight percent in toluene. The diluted preceramic silazane polymer solvent solution was then flow coated onto the coated electronic devices of Examples 1 through 4 and the solvent was allowed to evaporate by drying in the absence of air. By this means was deposited a preceramic polymer passivating coating which was ceramified by heating the coated device for approximately one hour at 400 degrees Centigrade under argon. Thin silicon-nitrogen-containing ceramic or ceramic-like passivating coatings of less than 2 microns (or approximately 3000 Angstroms) were thus produced on the devices.

EXAMPLE 6.

Using the procedure of Example 5, a preceramic silazane polymer containing about 5 percent titanium, prepared by the method of Haluska in Example 13 in U.S. Pat. No. 4,482,689, was flow coated onto the $SiO_2$/metal oxide coated electronic device and the solvent allowed to evaporate by drying. By this means was deposited a preceramic polymer coating which was ceramified by heating the coated device for approximately one hour at temperatures up to 400 degrees Centigrade under argon. Thin silicon nitrogen-containing ceramic or ceramic-like passivating coatings of less than 2 microns (or approximately 3000 Angstroms) were thus produced on the devices.

EXAMPLE 7.

Using the procedure of Example 5, a preceramic silazane polymer, prepared by the method of Gaul in Example 1 in U.S. Pat. No. 4,395,460, was coated onto the $SiO_2$/metal oxide coated electronic device and the solvent allowed to evaporate by drying. By this means was deposited a preceramic polymer coating which was ceramified by heating the coated device for approximately one hour at temperatures up to 400 degrees Centigrade under argon. Thin silicon nitrogen-containing ceramic or ceramic-like passivating coatings of less than 2 microns (or approximately 3000 Angstroms) were thus produced on the devices.

EXAMPLE 8.

A 1–2 weight % solution in diethyl ether of dihydridosilizane polymer, prepared by the method of Seyferth in Example 1 in U.S. Pat. No. 4,397,828, was flow coated onto CMOS devices coated by the methods of Examples 1–4, above. The coated devices were heated in nitrogen for one hour at 400° C. The coating and pyrolysis treatment did not adversely affect the function of the devices, as determined by a CMOS circuit tester. The coated devices withstood 0.1M NaCl exposure for over four and one half hours before circuit failure. A nonprotected CMOS device will fail to function after exposure to a 0.1M NaCl solution for less than one minute.

EXAMPLE 9.

The electronic devices coated with the planarizing and/or passivating coatings of Examples 1 through 8 were then overcoated with the barrier coats as follows; Hexafluorodisilane, 500 Torr, was placed in a Pyrex glass reaction container along with a CMOS electronic device, previously coated as above. The hexafluorodisilane was transferred to the glass container in such a manner as to preclude exposure to the atmosphere. The reaction container was then attached to a vacuum line, the contents evacuated, and the container thoroughly heated under vacuum with a gas-oxygen torch. The container was sealed with a natural gas-oxygen torch and heated in an oven for 30 minutes at a temperature of approximately 360 degrees Centigrade. During this time the hexafluorodisilane starting material decomposed and formed a silicon-containing topcoat on the previously coated electronic device. The reaction by-products, mixtures of various halosilanes, and any unreacted starting material were removed by evacuation after the container had been reattached to the vacuum line. The ceramic coated electronic device, onto which the decomposed hexafluorodisilane starting material had deposited a silicon-containing topcoating, was then removed.

EXAMPLE 10.

Using the procedure described in Example 9, dichlorodisilane was thermally decomposed in the presence of the ceramic or ceramic-like silicon nitrogen-containing coated electronic device. An amorphous silicon-containing topcoat was thereby deposited onto the ceramic or ceramic-like coated electronic device. The coated electronic device was tested and all electronic circuits were operable.

That which is claimed is:

1. A composition of matter comprising a hydrocarbon solvent solution of a mixture of (a) hydrogen silesquioxane resin; (b) one or more metal oxide precursors selected from the group consisting of an aluminum alkoxide, a titanium alkoxide and a zirconium alkoxide; and (c) a metal catalyst selected from the group consisting of platinum catalysts and rhodium catalysts, wherein the hydrogen silsesquioxane resin (a) is diluted in the hydrocarbon solvent to low solids, the metal oxide precursor or precursors (b) are present in an amount such that the resultant ceramic coating contains from 0.1 % weight percent up to approximately 30 % weight percent metal oxide, and the metal catalyst (c) is present in an amount sufficient to enhance the oxidation and cure of the hydrogen silsesquioxane resin.

2. The composition of claim 1 wherein said hydrocarbon solvent is selected from the group consisting of toluene, methyl ethyl ketone or n-heptane.

3. The composition of claim 1 wherein said hydrogen silsesquioxane resin is diluted to 0.1 to 10 % weight percent in said solvent.

4. The composition of claim 3 wherein said hydrogen silsesquioxane resin is diluted to 0.1 to 10 weight percent in said solvent.

5. The composition of claim 1 wherein said platinum or rhodium catalyst is selected from the group consisting of $(CH_3CH_2S)_2PtCl_2$, platinum acetylacetonate and $Rhcl_3(CH_3CH_2CH_2CH_2S)_3$.

* * * * *

UNITED STATES PATENT AND TRADEMARK OFFICE

CERTIFICATE OF CORRECTION

PATENT NO. : 5,008,320

DATED : 4/16/91

INVENTOR(S) : Loren A. Haluska, Keith W. Michael, and Leo Tarhay

It is certified that error appears in the above—identified patent and that said Letters Patent is hereby corrected as shown below:

Column 16, Line 48: "The composition of claim 3" should read "The composition of claim 2".

Column 16, Line 54: "$Rhcl_3(CH_3CH_2CH_2CH_2S)_3$." should read "$RhCl_3(CH_3CH_2CH_2CH_2S)_3$. Change the small "c" to a capital "C".

Signed and Sealed this

Fifteenth Day of December, 1992

*Attest:*

DOUGLAS B. COMER

*Attesting Officer*

*Acting Commissioner of Patents and Trademarks*